US011604025B2

(12) United States Patent
Chan et al.

(10) Patent No.: US 11,604,025 B2
(45) Date of Patent: Mar. 14, 2023

(54) STANDALONE HIGH-PRESSURE HEAVIES REMOVAL UNIT FOR LNG PROCESSING

(71) Applicant: ConocoPhillips Company, Houston, TX (US)

(72) Inventors: Jinghua Chan, Houston, TX (US); Qi Ma, Houston, TX (US); Dale L. Embry, Houston, TX (US); Attilio J. Praderio, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 0 days.

(21) Appl. No.: 17/072,565

(22) Filed: Oct. 16, 2020

(65) Prior Publication Data

US 2021/0116173 A1 Apr. 22, 2021

Related U.S. Application Data

(60) Provisional application No. 62/916,753, filed on Oct. 17, 2019.

(51) Int. Cl.

| | |
|---|---|
| ***F25J 3/02*** | (2006.01) |
| ***F25J 1/00*** | (2006.01) |
| ***F25J 1/02*** | (2006.01) |

(52) U.S. Cl.

CPC ..... *F25J 1/0022* (2013.01); *F25J 1/004* (2013.01); *F25J 1/0247* (2013.01); *F25J 3/0209* (2013.01);

(Continued)

(58) Field of Classification Search

CPC ..... F25J 3/0209; F25J 3/0233; F25J 3/0242; F25J 3/0247; F25J 3/0295; F25J 2200/72;

(Continued)

(56) References Cited

U.S. PATENT DOCUMENTS

| | | | |
|---|---|---|---|
| 2,959,540 | A | 11/1960 | Cahn et al. |
| 3,393,527 | A | 7/1968 | Swenson et al. |

(Continued)

FOREIGN PATENT DOCUMENTS

| | | | |
|---|---|---|---|
| WO | WO-2014149465 | A1 | 9/2014 |
| WO | WO-2017220591 | A1 | 12/2017 |
| WO | WO-2019099608 | A1 | 5/2019 |

OTHER PUBLICATIONS

International Search Report and Written Opinion for International Application No. PCT/US2020/055969 dated Jan. 14, 2021, 11 pages.

*Primary Examiner* — Brian M King

(74) *Attorney, Agent, or Firm* — Polsinelli PC

(57) ABSTRACT

Implementations described and claimed herein provide systems and methods for processing liquefied natural gas (LNG). In one implementation, a dry feed gas is received. The dry feed gas is chilled with clean vapor from a heavies removal column to form a chilled feed gas. The chilled feed gas is partially condensed into a vapor phase and a liquid phase. The liquid phase retains freezing components. The freezing components are extracted using a reflux stream in the heavies removal column. The freezing components are removed as a condensate. The vapor phase is compressed into a clean feed gas. The clean feed gas is free of the freezing components for downstream liquefaction.

16 Claims, 4 Drawing Sheets

(52) U.S. Cl.
CPC ..... *F25J 3/0233* (2013.01); *F25J 3/0242* (2013.01); *F25J 3/0295* (2013.01); *F25J 2200/02* (2013.01); *F25J 2200/76* (2013.01); *F25J 2200/78* (2013.01); *F25J 2205/02* (2013.01); *F25J 2220/60* (2013.01); *F25J 2220/64* (2013.01); *F25J 2245/02* (2013.01); *F25J 2270/12* (2013.01); *F25J 2270/60* (2013.01)

(58) Field of Classification Search
CPC .. F25J 2200/74; F25J 2200/38; F25J 2205/50; F25J 2220/64
See application file for complete search history.

(56) References Cited

U.S. PATENT DOCUMENTS

| | | | | |
|---|---|---|---|---|
| 4,421,535 | A | 12/1983 | Mehra | |
| 4,741,884 | A | 5/1988 | Carter et al. | |
| 5,325,673 | A * | 7/1994 | Durr | F25J 3/0209 62/634 |
| 6,023,942 | A * | 2/2000 | Thomas | F17C 1/002 62/613 |
| 6,401,486 | B1 | 6/2002 | Lee et al. | |
| 10,899,974 | B2 | 1/2021 | Davies et al. | |
| 2002/0059865 | A1 | 5/2002 | Lemaire et al. | |
| 2004/0177646 | A1 | 9/2004 | Wilkinson et al. | |
| 2008/0016910 | A1 | 1/2008 | Brostow et al. | |
| 2010/0000255 | A1 | 1/2010 | Mak | |
| 2010/0316806 | A1 | 12/2010 | He et al. | |
| 2013/0283853 | A1 | 10/2013 | Martinez et al. | |
| 2016/0200937 | A1 | 7/2016 | Hu et al. | |
| 2016/0258675 | A1 | 9/2016 | Kumar et al. | |
| 2017/0036139 | A1 | 2/2017 | Lee | |
| 2018/0066889 | A1 * | 3/2018 | Gaskin | F25J 3/0209 |
| 2018/0266757 | A1 | 9/2018 | Embry et al. | |
| 2019/0204007 | A1 | 7/2019 | Ducote, Jr. et al. | |
| 2020/0191477 | A1 * | 6/2020 | Mak | F25J 1/0022 |
| 2020/0386474 | A1 | 12/2020 | Chan et al. | |
| 2021/0095918 | A1 | 4/2021 | Calderon et al. | |

* cited by examiner

STANDALONE HIGH-PRESSURE HEAVIES REMOVAL UNIT FOR LNG PROCESSING

CROSS-REFERENCE TO RELATED APPLICATIONS

The present application claims benefit under 35 U.S.C. § 119(e) to U.S. Provisional Patent Application No. 62/916,753, entitled "Systems and Methods for Managing Inventory Usage" and filed on Oct. 17, 2019. This application is specifically incorporated by reference in its entirety herein.

BACKGROUND

I. Technical Field

Aspects the present disclosure relate generally to systems and methods for liquefaction of natural gas and more particularly to elimination of freezing during processing of liquefied natural gas (LNG) using a standalone heavies removal unit.

II. Related Art

Natural gas is a commonly used resource comprised of a mixture of naturally occurring hydrocarbon gases typically found in deep underground natural rock formations or other hydrocarbon reservoirs. More particularly, natural gas is primarily comprised of methane and often includes other components, such as, ethane, propane, carbon dioxide, nitrogen, hydrogen sulfide, and/or the like.

Cryogenic liquefaction generally converts the natural gas into a convenient form for transportation and storage. More particularly, under standard atmospheric conditions, natural gas exists in vapor phase and is subjected to certain thermodynamic processes to produce LNG. Liquefying natural gas greatly reduces its specific volume, such that large quantities of natural gas can be economically transported and stored in liquefied form.

Some of the thermodynamic processes generally utilized to produce LNG involve cooling the natural gas to near atmospheric vapor pressure. For example, a natural gas stream may be sequentially passed at an elevated pressure through multiple cooling stages that cool the gas to successively lower temperatures until the liquefaction temperature is reached. Stated differently, the natural gas stream is cooled through indirect heat exchange with one or more refrigerants, such as propane, propylene, ethane, ethylene, methane, nitrogen, carbon dioxide, and/or the like, and expanded to near atmospheric pressure.

During cooling of the processed natural gas stream, trace amounts of intermediate components, such as propanes, butanes, and pentanes, and heavy hydrocarbon components ("heavies"), such as C12 to C16 hydrocarbons, often freeze in downstream systems of in an LNG plant, including heat exchangers. As these components freeze during the cooling process, deposits buildup on internal surfaces of various systems of the LNG plant. Such fouling may result in a shutdown of one or more systems of the LNG plant to remove the deposits, resulting in a loss of production. For example, conventional LNG plants may experience an increase in pressure drop in a chilling area of the LNG train, such as a heat exchanger. The pressure drop may increase beyond system constraints unless train throughput is curtailed and eventually shutdown to de-rim the heat exchanger to remove deposits. Conventionally, the cycle of pressure drop increase, feed curtailment, shutdown, and de-riming of the heat exchanger continues as a result of fouling.

It is with these observations in mind, among others, that various aspects of the present disclosure were conceived and developed.

SUMMARY

Implementations described and claimed herein address the foregoing problems by providing systems and methods for processing liquefied natural gas (LNG). In one implementation, a dry feed gas is received. The dry feed gas is chilled with clean vapor from a heavies removal column to form a chilled feed gas. The chilled feed gas is partially condensed into a vapor phase and a liquid phase. The liquid phase retains freezing components. The freezing components are extracted using a reflux stream in the heavies removal column. The freezing components are removed as a condensate. The vapor phase is compressed into a clean feed gas. The clean feed gas is free of the freezing components for downstream liquefaction.

In another implementation, a partially condensed feed gas is received following an expansion of a chilled feed gas. Freezing components are extracted from the partially condensed feed gas using a reflux stream. A bottoms liquid containing the freezing components is output. The freezing components are removed as a condensate. A clean vapor free of the freezing components is output for downstream liquefaction. A portion of the clean vapor chills one or more feed streams, and a slip stream vapor of the clean vapor is used in producing the reflux stream.

Other implementations are also described and recited herein. Further, while multiple implementations are disclosed, still other implementations of the presently disclosed technology will become apparent to those skilled in the art from the following detailed description, which shows and describes illustrative implementations of the presently disclosed technology. As will be realized, the presently disclosed technology is capable of modifications in various aspects, all without departing from the spirit and scope of the presently disclosed technology. Accordingly, the drawings and detailed description are to be regarded as illustrative in nature and not limiting.

BRIEF DESCRIPTION OF THE DRAWINGS

The foregoing summary, as well as the following detailed description, will be better understood when read in conjunction with the appended drawing. For the purpose of illustration, there is shown in the drawing certain embodiments of the present inventive concept. It should be understood, however, that the present inventive concept is not limited to the precise embodiments and features shown. The accompanying drawing, which is incorporated in and constitutes a part of this specification, illustrates an implementation of apparatuses consistent with the present inventive concept and, together with the description, serves to explain advantages and principles consistent with the present inventive concept, in which.

DETAILED DESCRIPTION

Figure 1:
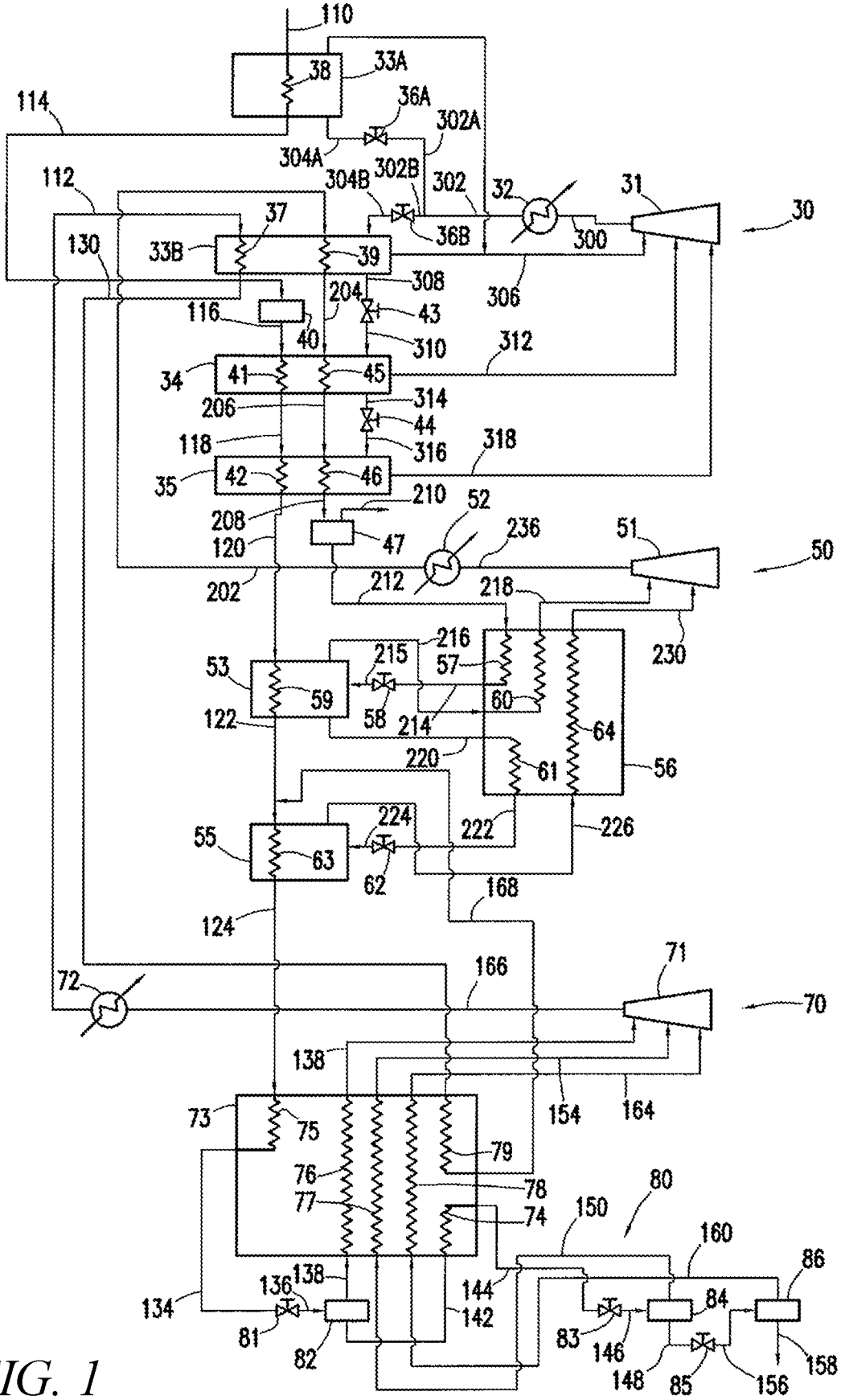
FIG. 1 illustrates an example simplified flow diagram of a cascade refrigeration process with a standalone heavies removal unit for removing freezing components during LNG production.

Aspects of the present disclosure involve systems and methods for reducing solid deposition during liquefaction in LNG production. In general, LNG plant feedstocks often contain freezing components, such as heavy hydrocarbon components "heavies" that form solids at the cryogenic temperatures associated with the natural gas liquefaction process. Even trace concentrations of such heavies can freeze during liquefaction. Accordingly, unless such heavies are sufficiently removed, solids form and deposit on process equipment in cold sections of the plant, thereby hindering plant operation and LNG production. Trace heavies in a lean feed gas are particularly difficult to remove. Thus, in one aspect, a refluxed heavies removal process is integrated into a high-pressure standalone heavies removal unit to independently remove heavies in connection with various LNG liquefaction processes and/or architecture. More particularly, an independent heavies removal process is deployed prior to liquefaction of a natural gas stream, thereby removing heavies in front of a liquefaction process. The standalone heavies removal process may include a refluxed absorber, such as a heavies removal column, a turboexpander, multiple internally integrated exchanges, a stabilizer, and/or the like. The reflux for the absorber may be an internally generated stream or an external natural gas liquids (NGL) stream (e.g., in connection with extremely lean gas cases). The standalone heavies removal process may be in front of the liquefaction process or integrated within the liquefaction process.

The presently disclosed technology thus: reliably eliminates freezing in chilling and liquefaction areas of the LNG train, thereby improving LNG production, lean gas processing, operational flexibility, and independence, and provides a customizable system that may deployable into various LNG train architectures, among other advantages that will be apparent from the present disclosure.

I. Terminology

The liquefaction process described herein may incorporate one or more of several types of cooling systems and methods including, but not limited to, indirect heat exchange, vaporization, and/or expansion or pressure reduction.

Indirect heat exchange, as used herein, refers to a process involving a cooler stream cooling a substance without actual physical contact between the cooler stream and the substance to be cooled. Specific examples of indirect heat exchange include, but are not limited to, heat exchange undergone in a shell-and-tube heat exchanger, a core-in-shell heat exchanger, and a brazed aluminum plate-fin heat exchanger. The specific physical state of the refrigerant and substance to be cooled can vary depending on demands of the refrigeration system and type of heat exchanger chosen.

Expansion or pressure reduction cooling refers to cooling which occurs when the pressure of a gas, liquid or a two-phase system is decreased by passing through a pressure reduction means. In some implementations, expansion means may be a Joule-Thomson expansion valve. In other implementations, the expansion means may be either a hydraulic or gas expander. Because expanders recover work energy from the expansion process, lower process stream temperatures are possible upon expansion.

In the description, phraseology and terminology are employed for the purpose of description and should not be regarded as limiting. For example, the use of a singular term, such as "a", is not intended as limiting of the number of items. Also, the use of relational terms such as, but not limited to, "down" and "up" or "downstream" and "upstream", are used in the description for clarity in specific reference to the figure and are not intended to limit the scope of the present inventive concept or the appended claims. Further, any one of the features of the present inventive concept may be used separately or in combination with any other feature. For example, references to the term "implementation" means that the feature or features being referred to are included in at least one aspect of the present inventive concept. Separate references to the term "implementation" in this description do not necessarily refer to the same implementation and are also not mutually exclusive unless so stated and/or except as will be readily apparent to those skilled in the art from the description. For example, a feature, structure, process, step, action, or the like described in one implementation may also be included in other implementations, but is not necessarily included. Thus, the present inventive concept may include a variety of combinations and/or integrations of the implementations described herein. Additionally, all aspects of the present inventive concept as described herein are not essential for its practice.

Lastly, the terms "or" and "and/or" as used herein are to be interpreted as inclusive or meaning any one or any combination. Therefore, "A, B or C" or "A, B and/or C" mean any of the following: "A"; "B"; "C"; "A and B"; "A and C"; "B and C"; or "A, B and C." An exception to this definition will occur only when a combination of elements, functions, steps or acts are in some way inherently mutually exclusive.

II. General Architecture and Operations

Some LNG projects introduce pipelines as a source of feed gas in an LNG Optimized Cascade Process (OCP). The Optimized Cascade Process is based on three multi-staged, cascading refrigerants circuits using pure refrigerants, brazed aluminum heat exchangers and insulated cold box modules. Pure refrigerants of propane (or propylene), ethylene, and methane may be utilized.

The Optimized Cascade Process may use a two-stage heavies removal unit (heavies removal unit or HRU) to eliminate C6+hydrocarbons (i.e. heavy components) from the natural gas prior to condensing the gas to LNG. In the usual case, the gas has already been amine treated and dehydrated prior to heavies removal. Heavies removal is done to prevent freezing from occurring in the liquefaction heat exchangers and to moderate the heating value of the LNG. It also prevents LNG from being outside specification limits due to increased levels of heavy components.

The presently disclosed technology may be implemented in a cascade LNG system employing a cascade-type refrigeration process using one or more predominately pure component refrigerants. The refrigerants utilized in cascade-type refrigeration processes can have successively lower boiling points to facilitate heat removal from the natural gas stream that is being liquefied. Additionally, cascade-type refrigeration processes can include some level of heat integration. For example, a cascade-type refrigeration process can cool one or more refrigerants having a higher volatility through indirect heat exchange with one or more refrigerants having a lower volatility. In addition to cooling the natural gas stream through indirect heat exchange with one or more refrigerants, cascade and mixed-refrigerant LNG systems can employ one or more expansion cooling stages to simultaneously cool the LNG while reducing its pressure.

In one implementation, the LNG process may employ a cascade-type refrigeration process that uses a plurality of multi-stage cooling cycles, each employing a different refrigerant composition, to sequentially cool the natural gas stream to lower and lower temperatures. For example, a first refrigerant may be used to cool a first refrigeration cycle. A second refrigerant may be used to cool a second refrigeration cycle. A third refrigerant may be used to cool a third refrigeration cycle. Each refrigeration cycle may include a closed cycle or an open cycle. The terms "first", "second", and "third" refer to the relative position of a refrigeration cycle. For example, the first refrigeration cycle is positioned just upstream of the second refrigeration cycle while the second refrigeration cycle is positioned upstream of the third refrigeration cycle and so forth. While at least one reference to a cascade LNG process comprising three different refrigerants in three separate refrigeration cycles is made, this is not intended to be limiting. It is recognized that a cascade LNG process involving any number of refrigerants and/or refrigeration cycles may be compatible with one or more implementations of the presently disclosed technology. Other variations to the cascade LNG process are also contemplated. It will also be appreciated that the presently disclosed technology may be utilized in non-cascade LNG processes. One example of a non-cascade LNG process involves a mixed refrigerant LNG process that employs a combination of two or more refrigerants to cool the natural gas stream in at least one cooling cycle.

Figure 2:
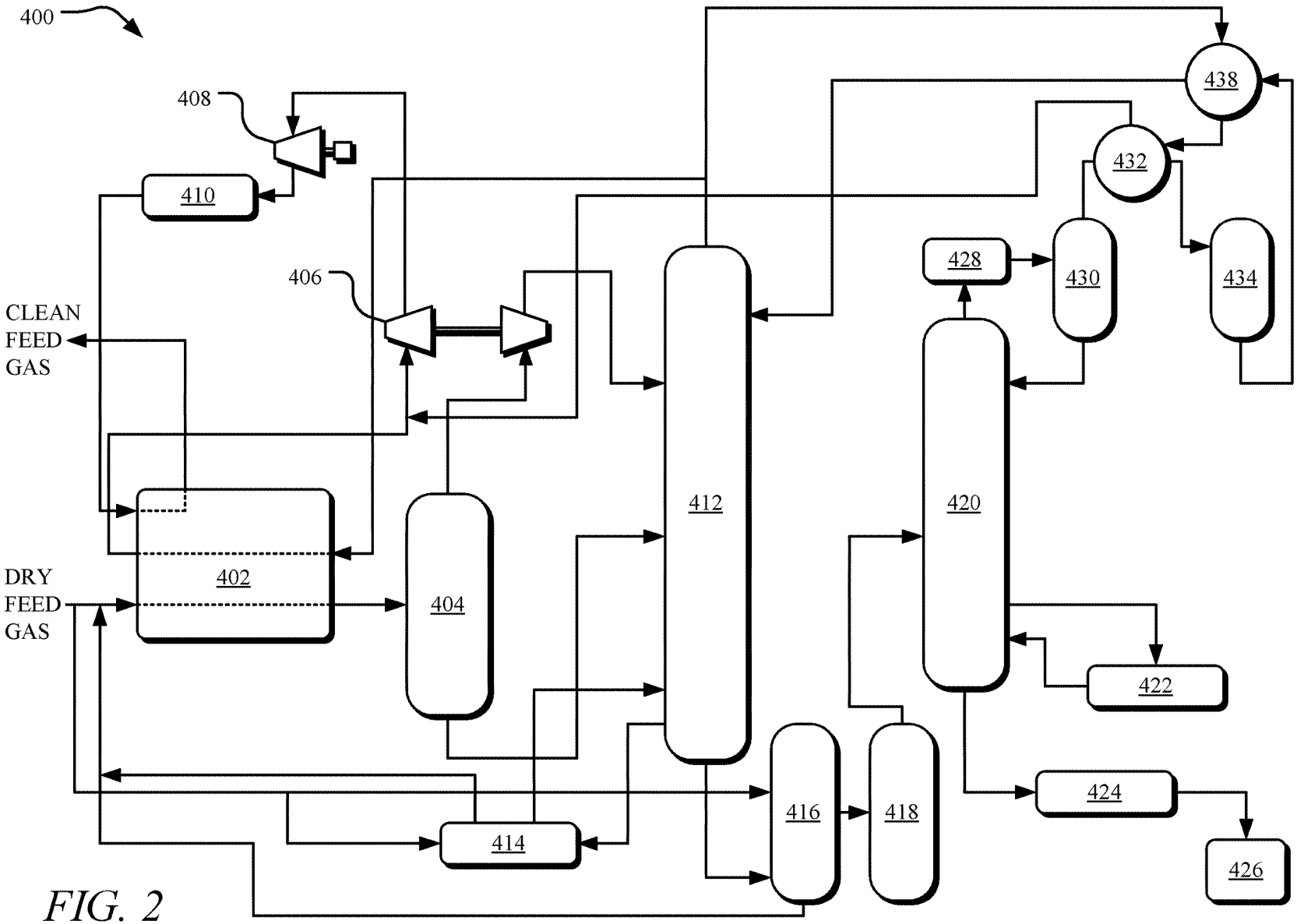
FIG. 2 shows an example LNG production system with a standalone heavies removal unit for removing freezing components.

To begin a detailed description of an example cascade LNG facility 100 in accordance with the implementations described herein, reference is made to FIG. 1. The LNG facility 100 generally comprises a first refrigeration cycle 30 (e.g., a propane refrigeration cycle), a second refrigeration cycle 50 (e.g., an ethylene refrigeration cycle), and a third refrigeration cycle 70 (e.g., a methane refrigeration cycle) with an expansion section 80. FIG. 2 illustrates shows an example LNG production system 400 with a standalone heavies removal process that may be integrated with or deployed in connection with an LNG producing facility, such as the LNG facility 100. Those skilled in the art will recognize that FIGS. 1-2 are schematics only and, therefore, various equipment, apparatuses, or systems that would be needed in a commercial plant for successful operation have been omitted for clarity. Such components might include, for example, compressor controls, flow and level measurements and corresponding controllers, temperature and pressure controls, pumps, motors, filters, additional heat exchangers, valves, and/or the like. Those skilled in the art will recognize such components and how they are integrated into the systems and methods disclosed herein.

In one implementation, the main components of propane refrigeration cycle 30 include a propane compressor 31, a propane cooler/condenser 32, high-stage propane chillers 33A and 33B, an intermediate-stage propane chiller 34, and a low-stage propane chiller 35. The main components of ethylene refrigeration cycle 50 include an ethylene compressor 51, an ethylene cooler 52, a high-stage ethylene chiller 53, a low-stage ethylene chiller/condenser 55, and an ethylene economizer 56. The main components of methane refrigeration cycle 70 include a methane compressor 71, a methane cooler 72, and a methane economizer 73. The main components of expansion section 80 include a high-stage methane expansion valve and/or expander 81, a high-stage methane flash drum 82, an intermediate-stage methane expansion valve and/or expander 83, an intermediate-stage methane flash drum 84, a low-stage methane expansion valve and/or expander 85, and a low-stage methane flash drum 86. While "propane," "ethylene," and "methane" are used to refer to respective first, second, and third refrigerants, it should be understood that these are examples only, and the presently disclosed technology may involve any combination of suitable refrigerants.

Referring to FIG. 1, in one implementation, operation of the LNG facility 100 begins with the propane refrigeration cycle 30. Propane is compressed in a multi-stage (e.g., three-stage) propane compressor 31 driven by, for example, a gas turbine driver (not illustrated). The stages of compression may exist in a single unit or a plurality of separate units mechanically coupled to a single driver. Upon compression, the propane is passed through a conduit 300 to a propane cooler 32 where the propane is cooled and liquefied through indirect heat exchange with an external fluid (e.g., air or water). A portion of the stream from the propane cooler 32 can then be passed through conduits 302 and 302A to a pressure reduction system 36A, for example, an expansion valve, as illustrated in FIG. 1. At the pressure reduction system 36A, the pressure of the liquefied propane is reduced, thereby evaporating or flashing a portion of the liquefied propane. A resulting two-phase stream then flows through a conduit 304A into a high-stage propane chiller 33A, which cools the natural gas stream in indirect heat exchange 38. A high stage propane chiller 33A uses the flashed propane refrigerant to cool the incoming natural gas stream in a conduit 110. Another portion of the stream from the propane cooler 32 is routed through a conduit 302B to another pressure reduction system 36B, illustrated, for example, in FIG. 1 as an expansion valve. At the pressure reduction system 36B, the pressure of the liquefied propane is reduced in a stream 304B.

The cooled natural gas stream from the high-stage propane chiller 33A flows through a conduit 114 to a separation vessel. At the separation vessel, water and in some cases a portion of the propane and/or heavier components are removed. In some cases where removal is not completed in upstream processing, a treatment system 40 may follow the separation vessel. The treatment system 40 removes moisture, mercury and mercury compounds, particulates, and other contaminants to create a treated stream. The stream exits the treatment system 40 through a conduit 116. The stream 116 then enters the intermediate-stage propane chiller 34. At the intermediate-stage propane chiller 34, the stream is cooled in indirect heat exchange 41 via indirect heat exchange with a propane refrigerant stream. The resulting cooled stream output into a conduit 118 is routed to the low-stage propane chiller 35, where the stream can be further cooled through indirect heat exchange means 42. The resultant cooled stream exits the low-stage propane chiller 35 through a conduit 120. Subsequently, the cooled stream in the conduit 120 is routed to the high-stage ethylene chiller 53.

A vaporized propane refrigerant stream exiting the high-stage propane chillers 33A and 33B is returned to a high-stage inlet port of the propane compressor 31 through a conduit 306. An un-vaporized propane refrigerant stream exits the high-stage propane chiller 33B via a conduit 308 and is flashed via a pressure reduction system 43, illustrated in FIG. 1 as an expansion valve, for example. The liquid propane refrigerant in the high-stage propane chiller 33A provides refrigeration duty for the natural gas stream. A two-phase refrigerant stream enters the intermediate-stage propane chiller 34 through a conduit 310, thereby providing coolant for the natural gas stream (in conduit 116) and the stream entering the intermediate-stage propane chiller 34 through a conduit 204. The vaporized portion of the propane refrigerant exits the intermediate-stage propane chiller 34 through a conduit 312 and enters an intermediate-stage inlet port of the propane compressor 31. The liquefied portion of the propane refrigerant exits the intermediate-stage propane chiller 34 through a conduit 314 and is passed through a pressure-reduction system 44, for example an expansion valve, whereupon the pressure of the liquefied propane refrigerant is reduced to flash or vaporize a portion of the liquefied propane. The resulting vapor-liquid refrigerant stream is routed to the low-stage propane chiller 35 through a conduit 316. At the low-stage propane chiller 35, the refrigerant stream cools the methane-rich stream and an ethylene refrigerant stream entering the low-stage propane chiller 35 through the conduits 118 and 206, respectively. The vaporized propane refrigerant stream exits the low-stage propane chiller 35 and is routed to a low-stage inlet port of the propane compressor 31 through a conduit 318. The vaporized propane refrigerant stream is compressed and recycled at the propane compressor 31 as previously described.

In one implementation, a stream of ethylene refrigerant in a conduit 202 enters the high-stage propane chiller 33B. At the high-stage propane chiller 33B, the ethylene stream is cooled through indirect heat exchange 39. The resulting cooled ethylene stream is routed in the conduit 204 from the high-stage propane chiller 33B to the intermediate-stage propane chiller 34. Upon entering the intermediate-stage propane chiller 34, the ethylene refrigerant stream may be further cooled through indirect heat exchange 45 in the intermediate-stage propane chiller 34. The resulting cooled ethylene stream exits the intermediate-stage propane chiller 34 and is routed through a conduit 206 to enter the low-stage propane chiller 35. In the low-stage propane chiller 35, the ethylene refrigerant stream is at least partially condensed, or condensed in its entirety, through indirect heat exchange 46. The resulting stream exits the low-stage propane chiller 35 through a conduit 208 and may be routed to a separation vessel 47. At the separation vessel 47, a vapor portion of the stream, if present, is removed through a conduit 210, while a liquid portion of the ethylene refrigerant stream exits the separator 47 through a conduit 212. The liquid portion of the ethylene refrigerant stream exiting the separator 47 may have a representative temperature and pressure of about −24° F. (about −31° C.) and about 285 psia (about 1,965 kPa). However, other temperatures and pressures are contemplated.

Turning now to the ethylene refrigeration cycle 50 in the LNG facility 100, in one implementation, the liquefied ethylene refrigerant stream in the conduit 212 enters an ethylene economizer 56, and the stream is further cooled by an indirect heat exchange 57 at the ethylene economizer 56. The resulting cooled liquid ethylene stream is output into a conduit 214 and routed through a pressure reduction system 58, such as an expansion valve. The pressure reduction system 58 reduces the pressure of the cooled predominantly liquid ethylene stream to flash or vaporize a portion of the stream. The cooled, two-phase stream in a conduit 215 enters the high-stage ethylene chiller 53. In the high-stage ethylene chiller 53, at least a portion of the ethylene refrigerant stream vaporizes to further cool the stream in the conduit 120 entering an indirect heat exchange 59. The vaporized and remaining liquefied ethylene refrigerant exits the high-stage ethylene chiller 53 through conduits 216 and 220, respectively. The vaporized ethylene refrigerant in the conduit 216 may re-enter the ethylene economizer 56, and the ethylene economizer 56 warms the stream through an indirect heat exchange 60 prior to entering a high-stage inlet port of the ethylene compressor 51 through a conduit 218. Ethylene is compressed in multi-stages (e.g., three-stage) at the ethylene compressor 51 driven by, for example, a gas turbine driver (not illustrated). The stages of compression may exist in a single unit or a plurality of separate units mechanically coupled to a single driver.

The cooled stream in the conduit 120 exiting the low-stage propane chiller 35 is routed to the high-stage ethylene chiller 53, where it is cooled via the indirect heat exchange 59 of the high-stage ethylene chiller 53. The remaining liquefied ethylene refrigerant exiting the high-stage ethylene chiller 53 in a conduit 220 may re-enter the ethylene economizer 56 and undergo further sub-cooling by an indirect heat exchange 61 in the ethylene economizer 56. The resulting sub-cooled refrigerant stream exits the ethylene economizer 56 through a conduit 222 and passes a pressure reduction system 62, such as an expansion valve, whereupon the pressure of the refrigerant stream is reduced to vaporize or flash a portion of the refrigerant stream. The resulting, cooled two-phase stream in a conduit 224 enters the low-stage ethylene chiller/condenser 55.

A portion of the cooled natural gas stream exiting the high-stage ethylene chiller 53 is routed through conduit a 122 to enter an indirect heat exchange 63 of the low-stage ethylene chiller/condenser 55. In the low-stage ethylene chiller/condenser 55, the cooled stream is at least partially condensed and, often, subcooled through indirect heat exchange with the ethylene refrigerant entering the low-stage ethylene chiller/condenser 55 through the conduit 224. The vaporized ethylene refrigerant exits the low-stage ethylene chiller/condenser 55 through a conduit 226, which then enters the ethylene economizer 56. In the ethylene economizer 56, vaporized ethylene refrigerant stream is warmed through an indirect heat exchange 64 prior to being fed into a low-stage inlet port of the ethylene compressor 51 through a conduit 230. As shown in FIG. 1, a stream of compressed ethylene refrigerant exits the ethylene compressor 51 through a conduit 236 and subsequently enters the ethylene cooler 52. At the ethylene cooler 52, the compressed ethylene stream is cooled through indirect heat exchange with an external fluid (e.g., water or air). The resulting cooled ethylene stream may be introduced through the conduit 202 into high-stage propane chiller 33B for additional cooling, as previously described.

The condensed and, often, sub-cooled liquid natural gas stream exiting the low-stage ethylene chiller/condenser 55 in a conduit 124 can also be referred to as a "pressurized LNG-bearing stream." This pressurized LNG-bearing stream exits the low-stage ethylene chiller/condenser 55 through the conduit 124 prior to entering a main methane economizer 73. In the main methane economizer 73, methane-rich stream in the conduit 124 may be further cooled in an indirect heat exchange 75 through indirect heat exchange with one or more methane refrigerant streams (e.g., 76, 77, 78). The cooled, pressurized LNG-bearing stream exits the main methane economizer 73 through a conduit 134 and is routed to the expansion section 80 of the methane refrigeration cycle 70. In the expansion section 80, the pressurized LNG-bearing stream first passes through a high-stage methane expansion valve or expander 81, whereupon the pressure of this stream is reduced to vaporize or flash a portion thereof. The resulting two-phase methane-rich stream in a conduit 136 enters into a high-stage methane flash drum 82. In the high-stage methane flash drum 82, the vapor and liquid portions of the reduced-pressure stream are separated. The vapor portion of the reduced-pressure stream (also called the high-stage flash gas) exits the high-stage methane flash drum 82 through a conduit 138 and enters into the main methane economizer 73. At the main methane economizer 73, at least a portion of the high-stage flash gas is heated through the indirect heat exchange means 76 of the main methane economizer 73. The resulting warmed vapor stream exits the main methane economizer 73 through the conduit 138 and is routed to a high-stage inlet port of the methane compressor 71, as shown in FIG. 1.

The liquid portion of the reduced-pressure stream exits the high-stage methane flash drum 82 through a conduit 142 and re-enters the main methane economizer 73. The main methane economizer 73 cools the liquid stream through indirect heat exchange 74 of the main methane economizer 73. The resulting cooled stream exits the main methane economizer 73 through a conduit 144 and is routed to a second expansion stage, illustrated in FIG. 1 as intermediate-stage expansion valve 83 and/or expander, as an example. The intermediate-stage expansion valve 83 further reduces the pressure of the cooled methane stream, which reduces a temperature of the stream by vaporizing or flashing a portion of the stream. The resulting two-phase methane-rich stream output in a conduit 146 enters an intermediate-stage methane flash drum 84. Liquid and vapor portions of the stream are separated in the intermediate-stage flash drum 84 and output through conduits 148 and 150, respectively. The vapor portion (also called the intermediate-stage flash gas) in the conduit 150 re-enters the methane economizer 73, wherein the vapor portion is heated through an indirect heat exchange 77 of the main methane economizer 73. The resulting warmed stream is routed through a conduit 154 to the intermediate-stage inlet port of methane compressor 71.

The liquid stream exiting the intermediate-stage methane flash drum 84 through the conduit 148 passes through a low-stage expansion valve 85 and/or expander, whereupon the pressure of the liquefied methane-rich stream is further reduced to vaporize or flash a portion of the stream. The resulting cooled two-phase stream is output in a conduit 156 and enters a low-stage methane flash drum 86, which separates the vapor and liquid phases. The liquid stream exiting the low-stage methane flash drum 86 through a conduit 158 comprises the liquefied natural gas (LNG) product at near atmospheric pressure. This LNG product may be routed downstream for subsequent storage, transportation, and/or use.

A vapor stream exiting the low-stage methane flash drum 86 (also called the low-stage methane flash gas) in a conduit 160 is routed to the methane economizer 73. The methane economizer 73 warms the low-stage methane flash gas through an indirect heat exchange 78 of the main methane economizer 73. The resulting stream exits the methane economizer 73 through a conduit 164. The stream is then routed to a low-stage inlet port of the methane compressor 71.

The methane compressor 71 comprises one or more compression stages. In one implementation, the methane compressor 71 comprises three compression stages in a single module. In another implementation, one or more of the compression modules are separate but mechanically coupled to a common driver. Generally, one or more intercoolers (not shown) are provided between subsequent compression stages.

As shown in FIG. 1, a compressed methane refrigerant stream exiting the methane compressor 71 is discharged into a conduit 166. The compressed methane refrigerant is routed to the methane cooler 72, and the stream is cooled through indirect heat exchange with an external fluid (e.g., air or water) in the methane cooler 72. The resulting cooled methane refrigerant stream exits the methane cooler 72 through a conduit 112 and is directed to and further cooled in the propane refrigeration cycle 30. Upon cooling in the propane refrigeration cycle 30 through a heat exchanger 37, the methane refrigerant stream is discharged into s conduit 130 and subsequently routed to the main methane economizer 73, and the stream is further cooled through indirect heat exchange 79. The resulting sub-cooled stream exits the main methane economizer 73 through a conduit 168 and then combined with the stream in the conduit 122 exiting the high-stage ethylene chiller 53 prior to entering the low-stage ethylene chiller/condenser 55, as previously discussed.

In some cases, solid deposition occurs early in the LNG process (i.e. the relative warmer section of the cryogenic process) when processing certain "lean" feed gases, which contain relatively low concentrations of mid-range components (C2-C5) but high concentrations of C6-C11 and C12+. Typically, C6-C11 freezing happens at the later section in the LNG process. However, with cryogenic conditions required for liquefying the natural gases, C12+ often forms solid deposition on the process equipment with even trace concentrations, which is problematic for plant operation and impairs LNG production. Stated, differently LNG plant feedstocks often contain heavy hydrocarbon components which tend to form solids (i.e. "freeze") at the cryogenic temperatures required for a natural gas liquefaction process. Without being sufficiently removed, the heavy components would freeze and deposit on the process equipment in the cold sections of the plant, which could eventually plug the equipment and result a plant shutdown. Thus, in some cases, the feed to the LNG facility 100 contains heavy hydrocarbon material which precipitates and collects in the high-stage ethylene chiller 53. The standalone heavies removal of the presently disclosed technology solves the freezing issues caused by such "lean" feed gases by removing very heavy freezing components (C12+) prior to the feed gases entering the chilling section in the LNG process, such as the high-stage ethylene chiller 53, therefore preventing the equipment from detriment.

In one implementation, heavy hydrocarbon components (C6+) in a feed of natural gas is removed in a standalone heavies removal unit to prevent solid deposition in downstream LNG processing. The standalone heavies removal unit may include a refluxed absorber, a turboexpander, one or more internally integrated exchangers, and a stabilizer (e.g., an NGL stabilizer), among other components. During the independent heavies removal process, heavies are frozen from the natural gas feed, and such extracted freezing components are processed in the stabilizer and removed as a condensate. The heavies removal process of the presently disclosed technology thus provides a flexible standalone process for removing freezing components, such as heavy hydrocarbon components, from a natural gas stream through a turboexpander and a reflux stream generated by a series of components, as described with respect to FIG. 2. The standalone heavies removal unit may be deployed in front of or integrated with a liquefaction process to prevent solid deposition, thereby providing design and operation flexibility operable for a wide range of natural gas compositions, pipeline compositional variations, and LNG architectures.

Turning to FIG. 2, an example LNG production system 400 with a standalone heavies removal unit for removing freezing components is shown. The LNG production system 400 may be deployed in the LNG facility 100, for example to curtail heavy hydrocarbon deposition in the high-stage ethylene chiller 53. In one implementation, the LNG production system 400 includes a feed gas exchanger 402 that receives a dry feed gas, for example, following dehydration. The LNG production system 400 further includes an expander 406, a heavies removal column 412, and a stabilizer 420, among other components and equipment.

In one implementation, the feed gas exchanger 402 chills the dry feed gas using vapor from overhead of the heavies removal column 412. The feed gas exchanger 402 thus forms a chilled feed gas. The chilled feed gas flows to an expander suction drum 404, which is a vertical separator that protects the expander 406 from erosion. The expander suction drum 404 removes any formed liquid from the chilled feed gas and directs the formed liquid to a lower section of the heavies removal column 412.

A vapor output from a top of the expander suction drum 404 flows through the expander 406 into an upper section of the heavies removal column 412 after expansion. During expansion in the expander 406, a pressure of the vapor is reduced, such that the outlet gas temperature drops, thereby leading to a partial condensation of the gas. In one implementation, the expander 406 is a turboexpander with: enough pressure and temperature reductions to condense freezing components; adequate pressure delivered to the other equipment of the LNG production system 400, including the pressure for removing heavies in the heavies removal column 412; and a power balance between the expander 406 and a recompressor 408. Thus, the feed gas can meet conditions (i.e. temperature, liquid fraction) for the heavies removal column 412 and the stabilizer 420 to remove the heavies, as described herein.

The partial condensation of the chilled feed gas provides a two-phase stream having a liquid phase and a vapor phase. The liquid phase formed through expansion using the expander 404 contains the freezing components. Stated differently, the freezing components are dropped out from the vapor phase and retained in the liquid phase, such that removal of the freezing components is achievable in separation equipment. In one implementation, the two-phase stream is fed into the upper section heavies removal column 412. As described herein, the heavies removal column 412 is a vertical vessel with an internal head which divides the vessel into two sections: the upper section and the lower section. A reflux stream (e.g., liquid reflux) is fed into a top bed of the upper section of the heavies removal column 412 to extract the freezing components (e.g., C5+). Depending on characteristics of the dry feed gas, a type of reflux used in the heavies removal column 412 may vary, providing flexibility to remove freezing components from a wide range of feed gas, which improves flexibility, reliability, and operability of the LNG facility 100.

Liquids collected at the lower section of the heavies removal column 412 may be routed to a heavies removal column reboiler 414 where light components are partially vaporized and sent back to the feed gas exchanger 402. The dry feed gas may be used as heating medium in the heavies removal column reboiler 414 and a stabilizer feed heater 416 on temperature control to maintain the temperature of heater vapor. The liquid from the heavies removal column reboiler 414 is sent to the lower section of the heavies removal column 412. From there, the liquid, joined by the liquid that may accumulate in the heavies removal column 412 to form heated bottoms liquid, is routed to the stabilizer feed heater 416 and a stabilizer hot oil feed heater 418 associated with the stabilizer 420. Thus, heated bottoms liquid is fed into the stabilizer 420.

Warmed clean vapor output by the heavies removal column 412 may be chilled in the feed gas exchanger 402. The clean feed gas output by the heavies removal column 412 is directed into the expander 406 for compression. The recompressor 408 may compress the clean feed gas using power generated by the expander 406, with additional compression being set by pressure corresponding to the downstream liquefaction process. Stated differently, the recompressor 408 may be a centrifugal compressor driven by work extracted by the expander 404, with additional compression being customizable. Following compression, the clean feed gas may be chilled using a recompressor aftercooler 410 and directed into the feed gas exchanger 402 to chill the dry feed gas. In other words, clean vapor from the heavies removal column 412 is used to chill the dry gas feed in the feed gas exchanger 402. The clean vapor from the heavies removal column 412 is further a main source for chilling other streams within the standalone heavies removal unit. The clean feed gas free of the freezing components is routed downstream for liquefaction, for example, chilling in the high-stage ethylene chiller 53.

In one implementation, following the heated bottoms liquid being fed into the stabilizer 420, lighter components (e.g., C4 and lighter) are distilled into the overhead of the stabilizer 420, while the heavier components (e.g., C6+ components) are removed in the liquid bottoms, as a condensate product. The stabilizer 420 may utilize a stabilizer reboiler 422 in connection with the distillation process. The liquid leaving the bottom of the stabilizer 420 is cooled in a condensate cooler 424 and then sent to a condensate storage 426. Overhead vapor from the stabilizer 420 is partially condensed in a stabilizer condenser 428, and the liquid and vapor are separated in a stabilizer reflux drum 430. The liquid is pumped and routed to a heavies removal column reflux condenser 432 for partial condensing. Vapor may be sent from the heavies removal column reflux condenser 432 to the expander 406. Liquid is sent from the heavies removal column reflux condenser 432 to a heavies removal column reflux drum 434, where it is directed to a reflux cooler 438 for chilling. The reflux cooler 438 directs the formed reflux stream to the heavies removal column 412 to extract the freezing components.

As described herein, in one implementation, a majority of the vapor from the heavies removal column 412 is utilized in the feed gas exchanger 402 to chill the dry feed gas, and a slip stream vapor is used for condensing the lighter components (e.g., C4 and lighter) from the stabilizer 420 to produce the heavy reflux for the heavies removal column 412. Utilizing this coldest vapor in the removal process retains desired C4 and lighter components in liquid phase and minimizes the loss of reflux material. It further improves independence of the standalone heavies removal unit, such that external refrigeration may be eliminated. However, external refrigeration may be used as a supplemental chilling media. The process further maximizes condensing of C2-C5 components in feed gas to reflux stream for the heavies removal column 412, which improves operational flexibility of the standalone heavies removal unit and increases a range of gas the LNG processing can handle. In other words, the LNG facility 100 can process a wider range of gas compositions and tolerate higher pipeline compositional variations.

In various implementations, an internal liquid recirculation and two-stage heavies removal process, a subcooled feed gas reflux, an external NGL injection for extremely lean gas cases, and/or the like may be utilized or deployed with the presently disclosed technology.

Figure 3:
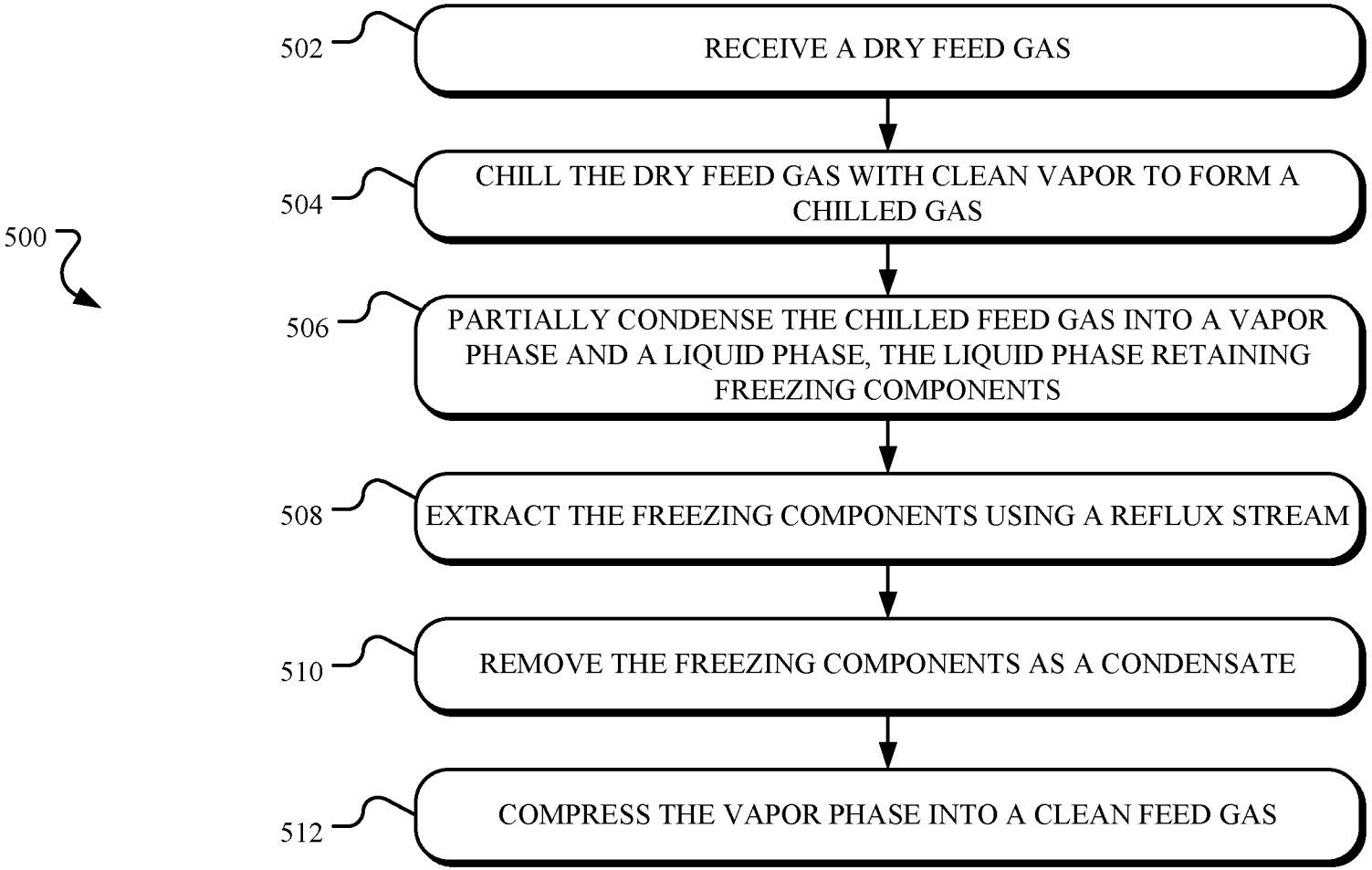
FIG. 3 illustrates example operations for reducing solid deposition during liquefaction in LNG production.

FIG. 3 illustrates example operations 500 for reducing solid deposition during liquefaction in LNG production. In one implementation, an operation 502 receives a dry feed gas, and an operation 504 chills the dry feed gas with clean vapor from a heavies removal column to form a chilled feed gas. An operation 506 partially condenses the chilled feed gas into a vapor phase and a liquid phase, where the liquid phase retains freezing components. An operation 508 extracts the freezing components using a reflux stream in the heavies removal column. An operation 510 removes the freezing components as a condensate, and an operation 512 compresses the vapor phase into a clean feed gas. The clean feed gas is free of the freezing components for downstream liquefaction.

Figure 4:
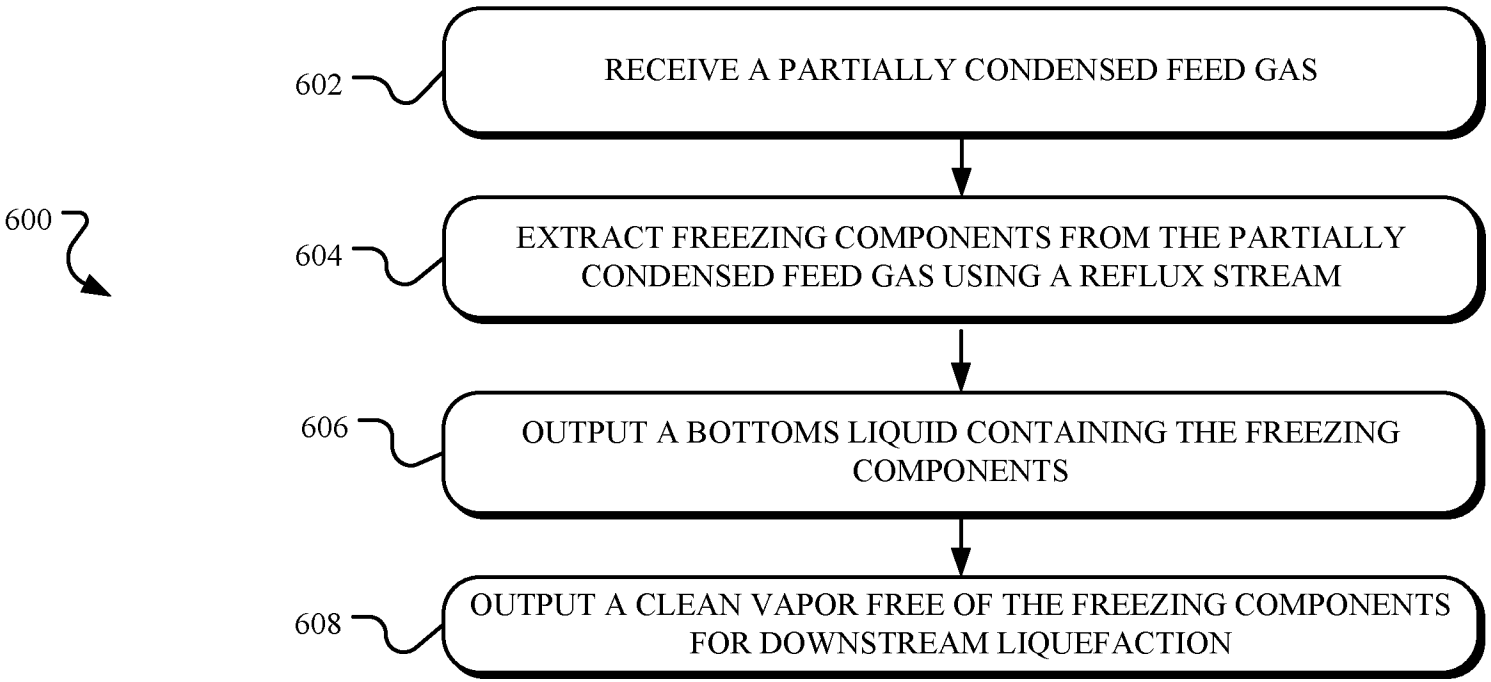
FIG. 4 illustrates example operations for heavies removal using a standalone heavies removal unit.

FIG. 4 illustrates example operations 600 for heavies removal using a standalone heavies removal unit. In one implementation, an operation 602 receives a partially condensed feed gas following an expansion of a chilled feed gas. An operation 604 extracts freezing components from the partially condensed feed gas using a reflux stream. An operation 606 outputs a bottoms liquid containing the freezing components, and the freezing components are removed as a condensate. An operation 608 outputs a clean vapor free of the freezing components for downstream liquefaction. A portion of the clean vapor chills one or more feed streams, and a slip stream vapor of the clean vapor is used in producing the reflux stream.

It will be appreciated that the example LNG production system 400 and example operations 500-600 are exemplary only and other systems or modifications to these systems may be used to eliminate or otherwise reduce fouling in the high-stage ethylene chiller 53 in accordance with the presently disclosed technology.

It is understood that the specific order or hierarchy of steps in the methods disclosed are instances of example approaches and can be rearranged while remaining within the disclosed subject matter. The accompanying method claims thus present elements of the various steps in a sample order, and are not necessarily meant to be limited to the specific order or hierarchy presented.

While the present disclosure has been described with reference to various implementations, it will be understood that these implementations are illustrative and that the scope of the present disclosure is not limited to them. Many variations, modifications, additions, and improvements are possible. More generally, implementations in accordance with the present disclosure have been described in the context of particular implementations. Functionality may be separated or combined in blocks differently in various implementations of the disclosure or described with different terminology. These and other variations, modifications, additions, and improvements may fall within the scope of the disclosure as defined in the claims that follow.

What is claimed is:

1. A method for reducing solid deposition during liquefaction in a liquefied natural gas (LNG) facility, the method comprising:

receiving a dry feed gas;

chilling the dry feed gas with clean vapor from a heavies removal column to form a chilled feed gas having liquid;

removing the liquid from the chilled feed gas prior to partially condensing the chilled feed gas into a vapor phase and a liquid phase;

partially condensing the chilled feed gas into the vapor phase and the liquid phase using an expander, the liquid phase retaining freezing components, wherein the vapor phase and the liquid phase are provided to the heavies removal column;

extracting the freezing components from the liquid phase using a reflux stream provided to the heavies removal column, the liquid removed from the chilled feed gas being provided to the heavies removal column;

and compressing the vapor phase into a clean feed gas, the clean feed gas being free of the freezing components for downstream liquefaction.

2. The method of claim 1, wherein the partially condensing of the chilled feed gas includes expanding the chilled feed gas.

3. The method of claim 1, wherein the reflux stream is an internally generated stream or an external natural gas liquids (NGL) stream.

4. The method of claim 1, wherein the reflux stream is produced using a slip stream vapor that condenses light components distilled during removal of the freezing components.

5. The method of claim 4, wherein the light components are C4 and lighter and the freezing components are C5 and higher.

6. A method for reducing solid deposition during liquefaction in a liquefied natural gas (LNG) facility, the method comprising:

removing liquid from chilled feed gas prior to partially condensing the chilled feed gas to yield partially condensed feed gas, the chilled feed gas produced by chilling one or more feed streams, the liquid removed from the chilled feed gas being provided to a heavies removal column;

receiving, at the heavies removal column, the partially condensed feed gas following an expansion of the chilled feed gas;

extracting freezing components from the partially condensed feed gas using a reflux stream provided to the heavies removal column;

outputting a bottoms liquid containing the freezing components from the heavies removal column, the freezing components removed as a condensate; and outputting, from the heavies removal column, a clean vapor free of the freezing components for downstream liquefaction, a portion of the clean vapor chilling the one or more feed streams, a slip stream vapor of the clean vapor used in producing the reflux stream.

7. The method of claim 6, further comprising:

expanding feed gas to form the partially condensed feed gas.

8. A system for reducing solid deposition during liquefaction in a liquefied natural gas (LNG) facility, the system comprising:

an upper section of a heavies removal column receiving a partially condensed feed gas, the heavies removal column being a standalone heavies removal unit, the upper section outputting a clean vapor free of freezing components for downstream liquefaction, wherein liquid is removed from chilled feed gas prior to partially condensing the chilled feed gas to yield the partially condensed feed gas, the liquid removed from the chilled feed gas being provided to the heavies removal column;

a top bed of the heavies removal column receiving a reflux stream produced using a slip stream vapor of the clean vapor, the reflux stream extracting the freezing components; and a lower section of the heavies removal column outputting a bottoms liquid containing the freezing components.

9. The system of claim 8, wherein the bottoms liquid containing the freezing components is fed into a stabilizer for removal as a condensate.

10. The system of claim 8, wherein the standalone heavies removal unit is deployed upstream of a liquefaction process or integrated with the liquefaction process.

11. The system of claim 8, further comprising:

a feed gas exchanger receiving a dry feed gas and the clean vapor from the heavies removal column, the feed gas exchanger chilling the dry feed gas with the clean vapor to form a chilled feed gas.

12. The system of claim 11, further comprising:

a turboexpander partially condensing the chilled feed gas into a vapor phase and a liquid phase, the liquid phase retaining the freezing components, the turboexpander compressing the the clean vapor into a clean feed gas.

13. The system of claim 12, wherein the lower section of the heavies removal column receives the liquid phase retaining the freezing components.

14. The system of claim 12, further comprising:

an expander suction drum, the chilled feed gas having the liquid flowing through the expander suction drum prior to entering the turboexpander, the expander suction drum removing the liquid prior to partial condensation in the turboexpander.

15. The system of claim 14, wherein the liquid is fed to the lower section of the heavies removal column, a vapor from the turboexpander being fed into the upper section of the heavies removal column.

16. The system of any of claim 8, further comprising:

a compressor providing compression of the clean vapor set by pressure for the downstream liquefaction.

* * * * *